US006652223B1

(12) United States Patent
Horng et al.

(10) Patent No.: US 6,652,223 B1
(45) Date of Patent: Nov. 25, 2003

(54) FAN STRUCTURE HAVING HORIZONTAL CONVECTION

(75) Inventors: Alex Horng, Kaohsiung (TW); Ching-Shen Hong, Kaohsiung (TW)

(73) Assignee: Sunonwealth Electric Machine Industry, Kaohsiung (TW)

( * ) Notice: Subject to any disclaimer, the term of this patent is extended or adjusted under 35 U.S.C. 154(b) by 0 days.

(21) Appl. No.: 10/157,111

(22) Filed: May 30, 2002

(51) Int. Cl.[7] ..... F04D 29/40

(52) U.S. Cl. ..... 415/53.1; 415/116; 415/203; 361/687; 361/692; 361/695

(58) Field of Search ..... 415/175–178, 415/203, 53.1, 53.2, 53.3, 185, 186, 116; 417/354; 361/687, 692, 693, 695, 696, 697

(56) References Cited

U.S. PATENT DOCUMENTS

| | | | | | |
|---|---|---|---|---|---|
| 341,218 | A | * | 5/1886 | Blakely | 415/186 |
| 6,104,607 | A | * | 8/2000 | Behl | 361/687 |
| 6,111,748 | A | * | 8/2000 | Bhatia | 361/695 |
| 6,141,214 | A | * | 10/2000 | Ahn | 361/687 |
| 6,227,286 | B1 | * | 5/2001 | Katsui | 361/697 |

* cited by examiner

*Primary Examiner*—Christopher Verdier
(74) *Attorney, Agent, or Firm*—Bacon & Thomas, PLLC

(57) ABSTRACT

A fan structure having horizontal convention includes a casing and a cross-flow type fan wheel. The casing includes an air inlet, an air outlet, and a horizontal channel directly connected therebetween. The cross-flow type fan wheel is mounted in the horizontal channel and selectively aligned or misaligned with a center of the casing.

4 Claims, 6 Drawing Sheets

FAN STRUCTURE HAVING HORIZONTAL CONVECTION

BACKGROUND OF THE INVENTION

1. Field of the Invention

The present invention is related to a fan structure having horizontal convection and more particularly to a horizontal channel directly connecting an air inlet to an air outlet, and a cross-flow type blower fan wheel mounted therein being adapted to drive a horizontal airflow to pass therethrough so as to enhance the amount of horizontal airflow in a limited thickness thereof.

2. Description of the Related Art

Most of traditional fan designs have an air inlet at the top, and an air outlet at the side, such that an air gap with appropriate height communicates with the air inlet for sucking ambient air at the top. However, the total thickness of the traditional fan cannot be effectively reduced and it is undesired for an electronic device with a specific thin thickness, notebook computer for example.

Hence, there is a need for reducing the total thickness of fan which is capable of applying in a specific thin electronic device. To this end, Taiwanese Patent Publication No. 471660 (hereinafter referred to as the No. 471660 patent), published on Jan. 1, 2002, discloses a utility model "thin thickness type fan." The thin thickness type fan is characterized in that a casing comprises an air inlet and an air outlet formed on a sidewall, and a high difference existed between the air inlet and the air outlet with relation to a common bottom plane.

FIG. 1 illustrates a perspective view of the fan of the No. 471660 patent. FIG. 2 illustrates a partially sectional view of the fan of the No. 471660 patent. FIG. 3 illustrates a perspective view of the fan of the No. 471660 patent applied to a notebook computer.

Referring to FIG. 1, a casing 10 of a fan 1 comprises an air inlet 11 and an air outlet 12 defined on a sidewall respectively. A high difference exists between the air inlet 11 and the air outlet 12. Consequently, the height of the air inlet 11 is higher than that of the air outlet 12.

Referring to FIG. 2, an axial propeller blade 13 is disposed between the air inlet 11 and the air outlet 12 for blowing airflow. The bottom plane must descend to the air outlet 12 due to the high difference between the air inlet 11 and the air outlet 12. The bottom plate's thickness of the air outlet 12 is thinner than that of the air inlet 11 and thus the entire structure is sophisticated. Meanwhile, the air outlet 12 is horizontally misaligned with the air inlet 11 that obviously results in an obstruction of airflow therethrough and a reduced efficiency of air speed therebetween. Also, the high difference between the air inlet 11 and the air outlet 12 obviously increases total thickness of the fan 1, and it fails to meet the current trend of thin-thickness design.

Referring again to FIG. 2, an axial airflow driven by the axial propeller 13 is perpendicular to an orientation running between the air inlet 11 and the air outlet 12. In the fan 1, axial direction of the airflow driven by the axial propeller 13 has become indirect to both the air inlet 11 and the air outlet 12 located on the bottom plane that results in reduction of airflow efficiency therein.

Referring to FIG. 3, the fan 1 is assembled to a corner of a notebook computer 2. The air inlet 11 and air outlet 12 of the fan 1 is only abutted against an air inlet 21 and an air outlet 22 of the computer 2 respectively. Consequently, the fan 1 cannot simultaneously remove ambient heat from other electronic components in the computer 2.

The present invention intends to provide a fan having a horizontal channel directly connecting an air inlet to an air outlet with respect to a common plane, and a cross-flow type blower fan wheel mounted therein being adapted to drive a horizontal airflow to pass therethrough in such a way as to mitigate and overcome the above problem.

SUMMARY OF THE INVENTION

The primary objective of this invention is to provide a fan structure having horizontal convection which comprises a horizontal channel directly connecting an air inlet to an air outlet to reduce an airflow obstruction due to misalignment therebetween that enhances horizontal airflow to pass therethrough.

The secondary objective of this invention is to provide the fan structure having horizontal convection which utilizes a cross-flow type blower fan wheel in a limited thickness thereof so as to enhance airflow efficiency therein.

Another objective of this invention is to provide a fan structure having horizontal convection in which a cross-flow type blower fan wheel is proximate the air outlet thereof so as to effectively dissipate ambient heat therein.

The present invention is a fan structure having horizontal convection. The fan mainly comprises a casing and a cross-flow type fan wheel. The casing includes an air inlet, an air outlet, and a horizontal channel directly connected therebetween. The cross-flow type fan wheel is mounted in the horizontal channel and selectively aligned or misaligned with a center of the casing.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

Figure 1:
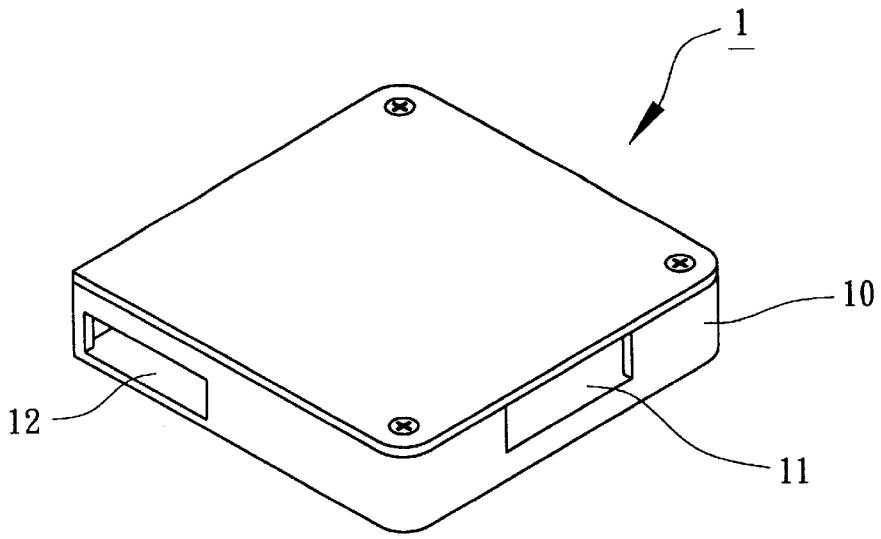
FIG. 1 PRIOR ART
FIG. 1 is a perspective view of a conventional fan in accordance with Taiwanese Patent Publication No. 471660.
Figure 2:
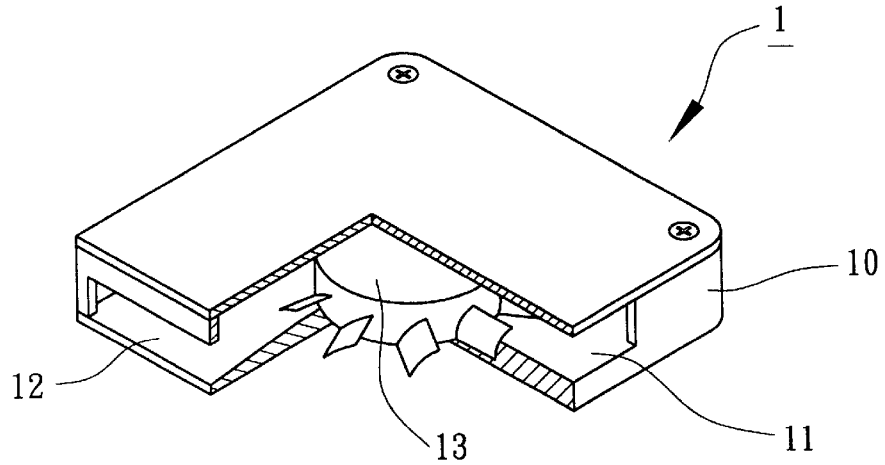
FIG. 2 PRIOR ART
FIG. 2 is a perspective view of the conventional fan having a portion of the corner cut away in accordance with Taiwanese Patent Publication No. 471660.

Referring now to the drawings, there are two embodiments of the present invention shown therein, both of which include generally a primary casing member and a secondary cross-flow type blower fan wheel member.

Figure 4:
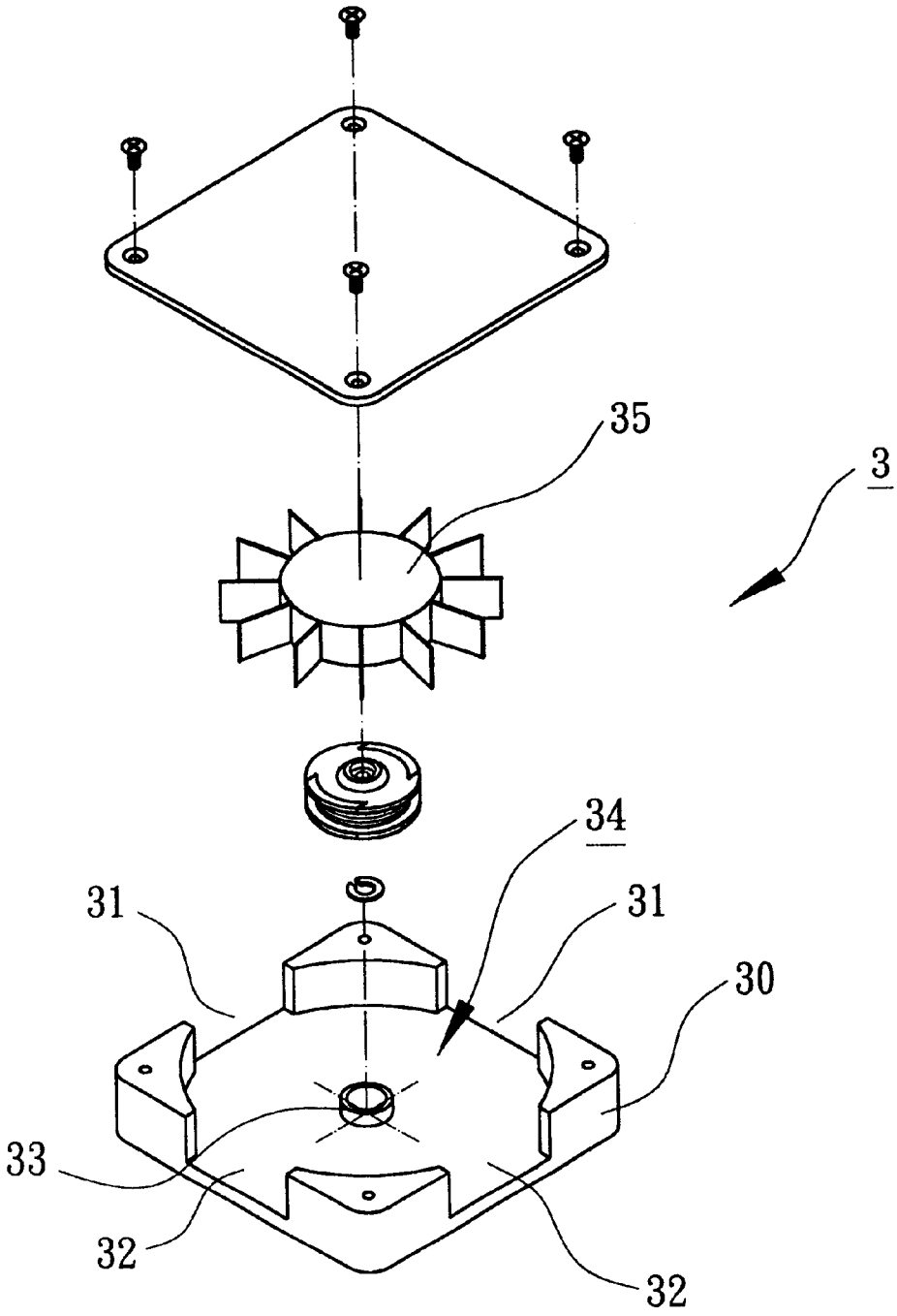
FIG. 4 is an exploded perspective view of a fan structure having horizontal convection in accordance with a first embodiment of the present invention.
Figure 5:
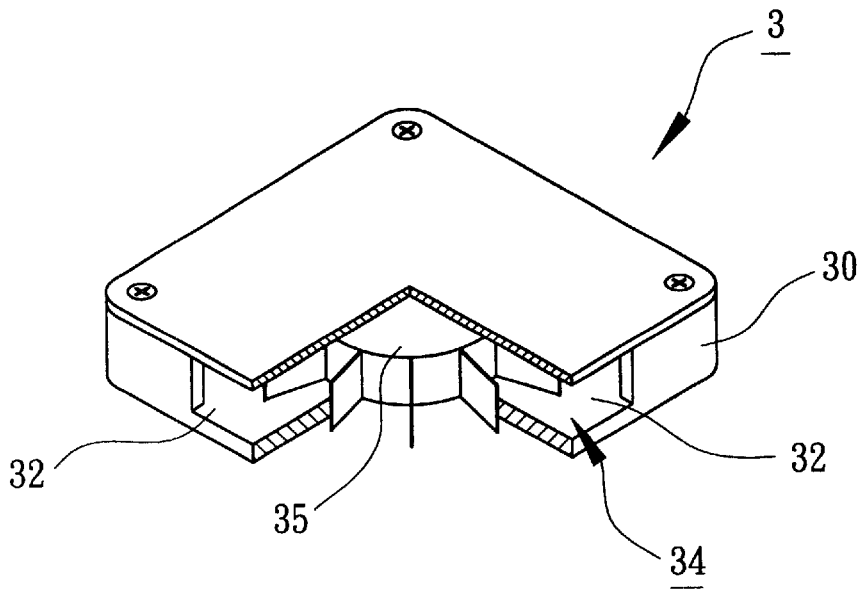
FIG. 5 is a perspective view of the fan structure having a portion of the corner cut away in accordance with the first embodiment of the present invention.
Figure 6:
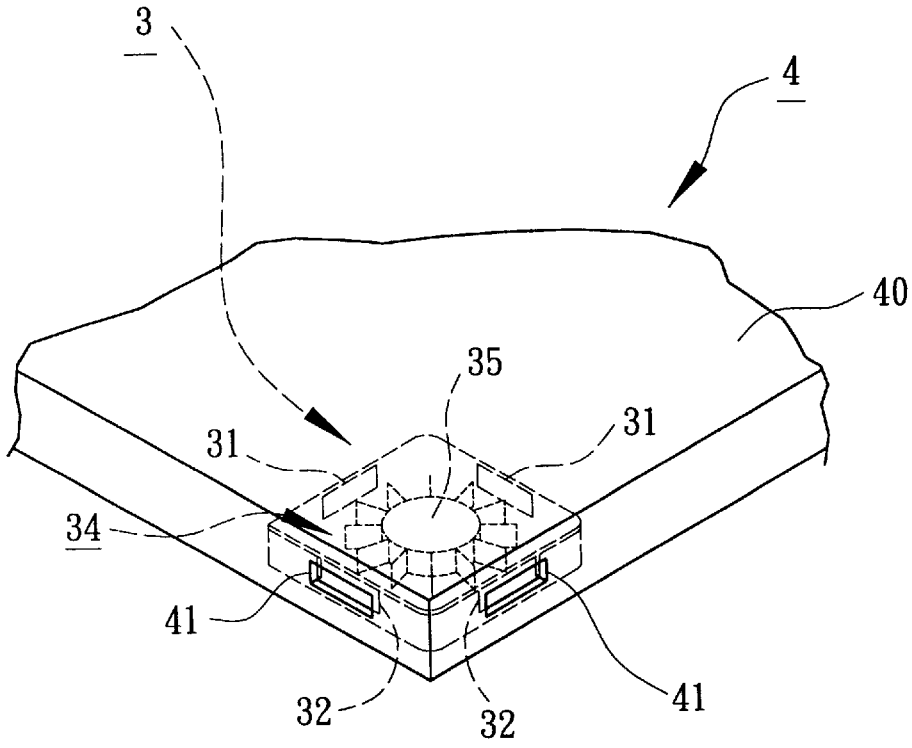
FIG. 6 is an enlarged partial schematic view of the fan structure assembled in a notebook computer in accordance with the first embodiment of the present invention.

Referring initially to FIGS. 4 through 6, a fan designated as numeral 3 having horizontal convention in accordance with the first embodiment of the present invention generally includes a casing designated as numeral 30, a cross-flow type blower fan wheel designated as numeral 35, and a motor (not labeled). The cross-flow type blower fan wheel 35 and the motor are axially nested in the casing 30.

Construction of the casing 30 shall be described in detail, referring now to FIGS. 4 and 5. The casing is made of heat conductive material, which is attached to heat sources such as a CPU or electronic component for heat dissipation purposes. The casing 30 is substantially comprised of a bottom plane, and separate sidewalls in which two air inlets 31 and two air outlets 32 are formed, the air inlets and outlets being uniformly spaced in series with respect to a center 33 of the casing 30. A horizontal channel 34 directly connects the air inlets 31 to the air outlets 32 with respect to the common bottom plane. The cross-flow type blower fan wheel 35 is rotatably disposed in the air channel 34 and a center of the fan wheel 35 is axially aligned with the center 33 with respect to a reference axis. In addition, the fan 3 can be selectively comprised of a lid (not labeled) adapted to cover a portion of the casing 30. Similarly, a casing of the computer may be adapted for use as the lid.

Assembling the fan 3 in a notebook computer shall now be described with reference to FIG. 6. As the fan 3 is mounted in a limited thickness of a casing 40 of a notebook computer 4, the two air inlets 31 are aligned with an interior of the computer 4 while the two air outlets 32 are aligned with two air outlets 41 of the computer 4. Hence, ambient heat from interior electronic components can be dissipated via the air outlets 41 of the casing 40.

Referring back to FIGS. 4 through 6, when the motor initially rotates the cross-flow type blower fan wheel 35, some air may flow out from the air outlets 32 and 41 beyond the casing 40 of the computer 4. Subsequently, the motor successively rotates the cross-flow type blower fan wheel 35 for a while, so as to form air pressure between the air inlets 31 and the air outlets 32. Airflow due to horizontal convection is forced between the air inlets 31 and the air outlets 32 and guided by the horizontal channel 34. Consequently, ambient heat from other interior electronic components can be simultaneously dissipated via the air outlets 41 of the casing 40.

Figure 7:
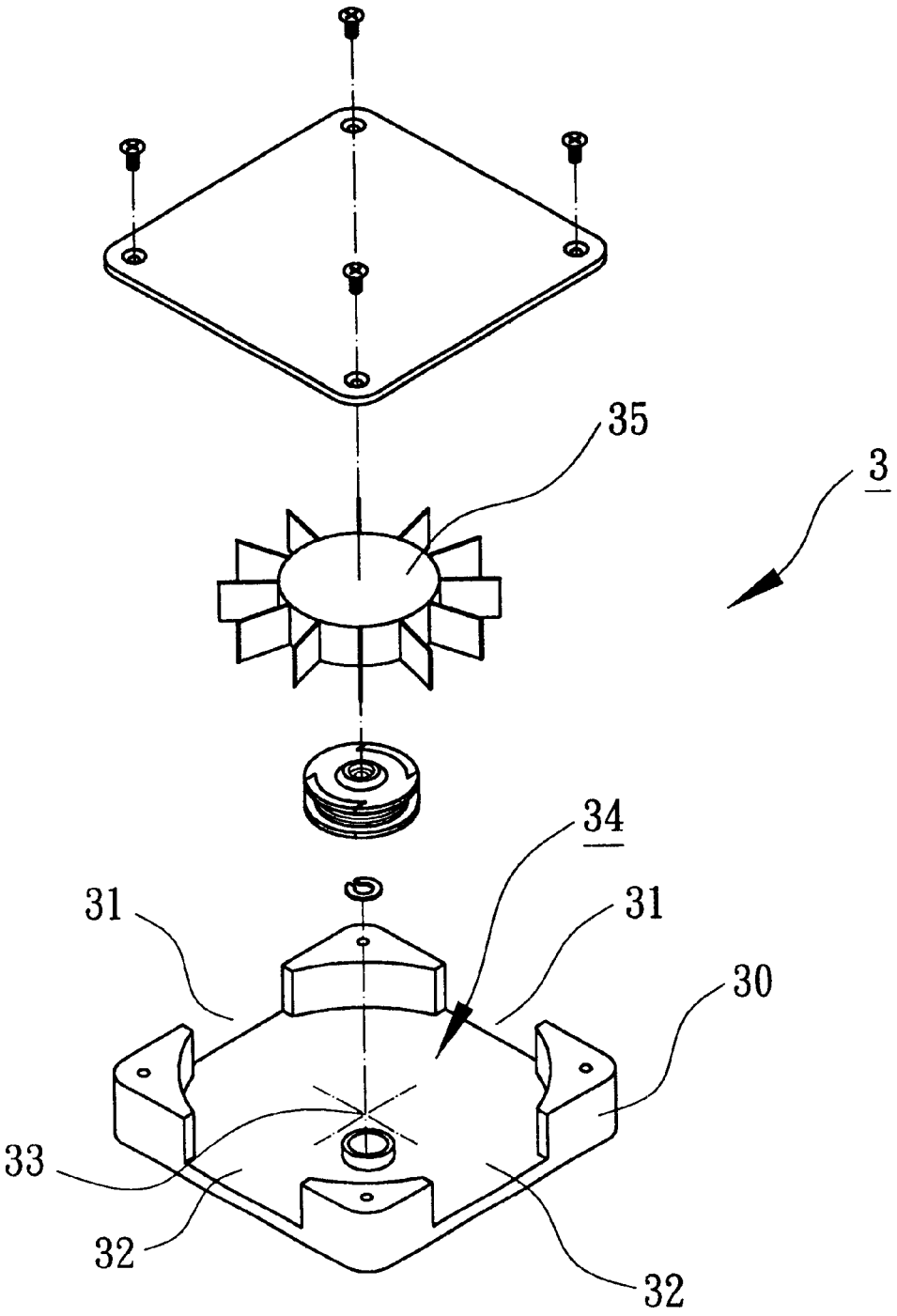
FIG. 7 is an exploded perspective view of a fan structure having horizontal convection in accordance with a second embodiment of the present invention.
Figure 8:
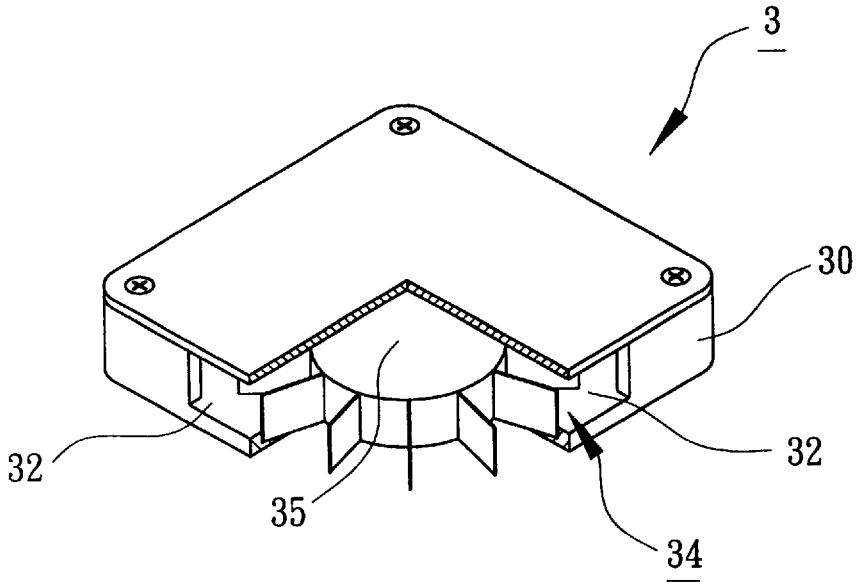
FIG. 8 is a perspective view of the fan structure having a portion of the corner cut away in accordance with the second embodiment of the present invention.
Figure 9:
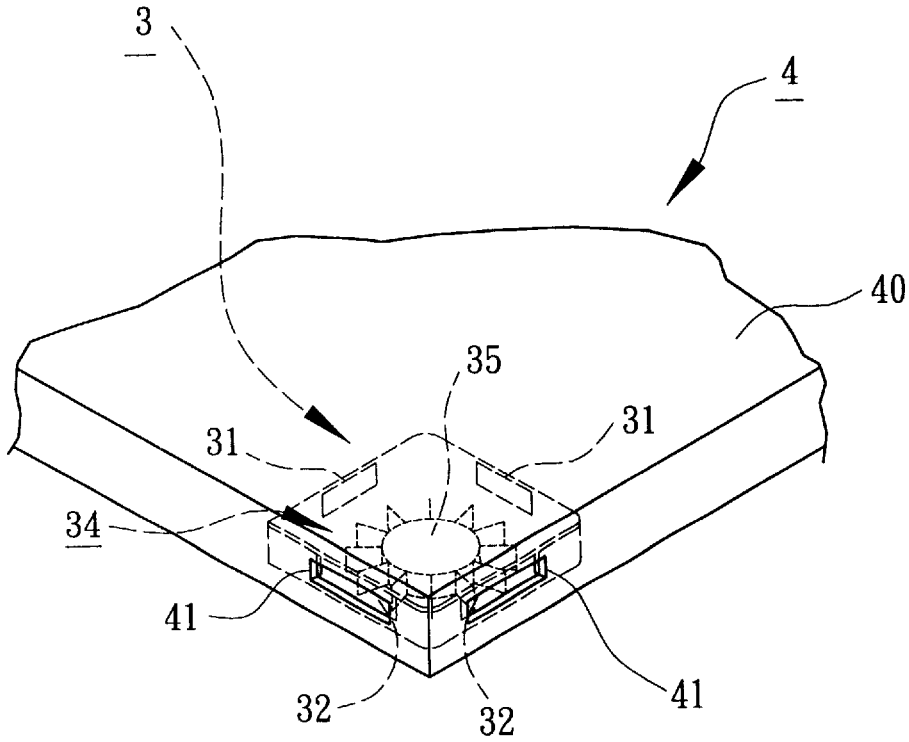
FIG. 9 is an enlarged partial schematic view of the fan structure assembled in a notebook computer in accordance with the second embodiment of the present invention.

Referring to FIGS. 7 through 9, reference numerals of a second embodiment have the identical numerals as the first embodiment. The casing 30, the cross-flow type blower fan wheel 35, and the motor of the second embodiment have a similar configuration and a same function as those of the first embodiment and the detailed descriptions are omitted. The cross-flow type blower fan wheel 35 is rotatably disposed in the air channel 34. The center of the fan wheel 35 is misaligned with the center 33 of the casing 30 so that it is positioned a predetermined distance from the air outlets 32.

Referring again to FIGS. 7 through 9, when the motor initially rotates the cross-flow type blower fan wheel 35, some may be rapidly forced from the air outlets 32 beyond the casing 40 of the computer 4. Consequently, ambient heat from other interior electronic components can be simultaneously dissipated via the air outlets 41 of the casing 40.

Referring back to FIGS. 1, 4, and 7, the casing 10 of the conventional fan 1 is designed with a high difference between the air inlet 11 and the air outlet 12, and the structure thereof is sophisticated. The conventional fan 1 also adopts an axial propeller 13 that results in lower airflow efficiency. However, the casing 30 of the fan 3 of the present invention comprises a horizontal channel 34 directly connecting the air inlets 31 to the air outlets 3, so as to enhance airflow efficiency. Also, the casing 30 of the fan 3 of the parent invention comprises a cross-flow type blower fan wheel so that the rate of heat dissipation is increased.

Figure 3:
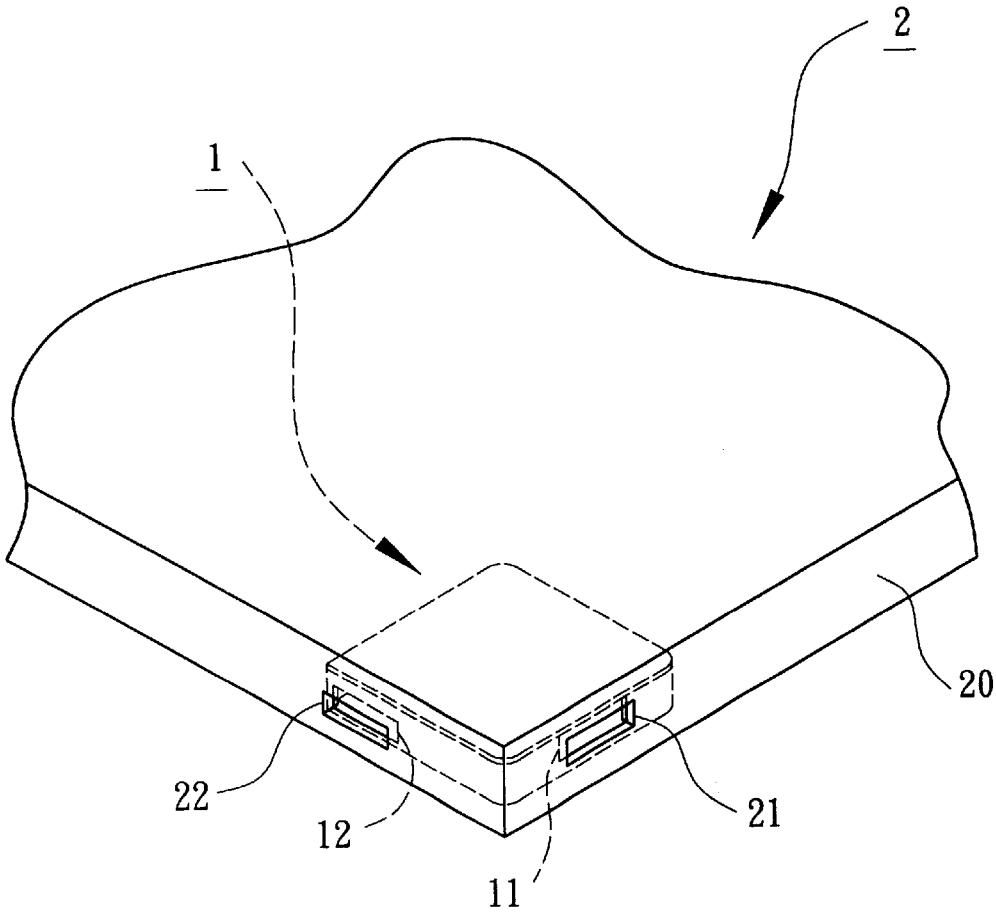
FIG. 3 PRIOR ART
FIG. 3 is an enlarged partial schematic view of the conventional fan assembled in a notebook computer in accordance with Taiwanese Patent Publication No. 471660.

Referring back to FIGS. 3, 6, and 9, the air inlet 11 and the air outlet 12 of the conventional fan 1 are aligned with the air inlet 21 and the air 22 of the casing respectively. It is incapable of dissipating ambient heat from other electronic components in the casing 20. However, according to the present invention, the air inlets 31 are aligned with the interior of the casing 40 while the air outlets 32 are aligned with the air outlets of the casing 40. Consequently, ambient heat from other interior electronic components can be simultaneously dissipated via the air outlets of the casing 40.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A fan structure having horizontal convection, comprising:

a casing including at least one air inlet, at least one air outlet, and a horizontal channel directly connecting the air inlet to the air outlet; and a blower fan wheel mounted in the horizontal channel, wherein a center of the blower fan wheel is misaligned with that of the casing so that the blower fan wheel is positioned proximate the air outlet of the casing, and wherein when the blower fan wheel is rotated, an air pressure difference is generated between the air inlet and the air outlet to thereby convect an airflow therebetween.

2. The fan structure having horizontal convection as defined in claim 1, further comprising a lid covering a top portion of the casing.

3. The fan structure having horizontal convection as defined in claim 1, wherein the fan is assembled in a casing of a notebook computer, and the air inlet of the fan is aligned with an interior of the notebook computer while the air outlet of the fan is aligned with an air outlet of the notebook computer.

4. The fan structure having horizontal convention as defined in claim 1, wherein the at least one air inlet and the at least one air outlet include two air inlets and two air outlets, each respectively formed in a separate sidewall of the casing.

* * * * *